US005357242A

United States Patent [19]

Morgano et al.

[11] Patent Number: 5,357,242

[45] Date of Patent: Oct. 18, 1994

[54] AIR PRESSURE GAUGE WITH SELF CONTAINED ADJUSTABLE ALARMS

[76] Inventors: Ralph R. Morgano, 901 Cromwell Ave., Westchester, Ill. 60154; Russell N. Reiling, 2527 Bucida Dr., Sarasota, Fla. 34239; Russell N. Reiling, Jr., PSC 251 Box 1265, APO AP 96542-5368, Guam

[21] Appl. No.: 986,670

[22] Filed: Dec. 8, 1992

[51] Int. Cl.[5] ..... G08B 21/00

[52] U.S. Cl. ..... 340/626; 340/688; 73/732; 73/741

[58] Field of Search ..... 340/626, 688, 693; 73/732, 733, 741, 756, 431

[56] References Cited

U.S. PATENT DOCUMENTS

| | | | |
|---|---|---|---|
| 3,129,416 | 4/1964 | Freedman | 540/688 |
| 3,715,927 | 2/1973 | Grant | 73/732 |
| 4,016,536 | 4/1977 | La Chapelle | 340/688 |
| 4,536,756 | 8/1985 | DePasquale et al. | 340/688 |
| 4,613,851 | 9/1986 | Hines | 340/688 |
| 4,636,776 | 1/1987 | Leaming | 340/688 |
| 4,800,373 | 1/1989 | Mayz | 340/626 |
| 4,906,977 | 3/1990 | Huey-Jeng | 340/688 |
| 5,051,729 | 9/1991 | Gray | 340/626 |
| 5,121,109 | 6/1992 | Murphy, Jr. et al. | 340/688 |
| 5,191,317 | 3/1993 | Toth et al. | 340/626 |

*Primary Examiner*—Mark R. Powell
*Assistant Examiner*—John W. Miller
*Attorney, Agent, or Firm*—Bullwinkel Partners, Ltd.

[57] ABSTRACT

A diver's air tank pressure gauge having audible and visual alarms, an alarm pointer for indicating the pressure at which the alarms will activate, and a crank assembly for changing the position of the alarm pointer. The pressure gauge dial has a cutout for limiting the travel of the alarm pointer between acceptable high and low pressure limits. When the air tank pressure equals a preset alarm pressure, an electrical circuit is completed which activates the alarms. The diver can then turn off the alarms by resetting the alarm indicator to a lower pressure setting and continue the dive at a shallower depth.

4 Claims, 2 Drawing Sheets

Fig. 1
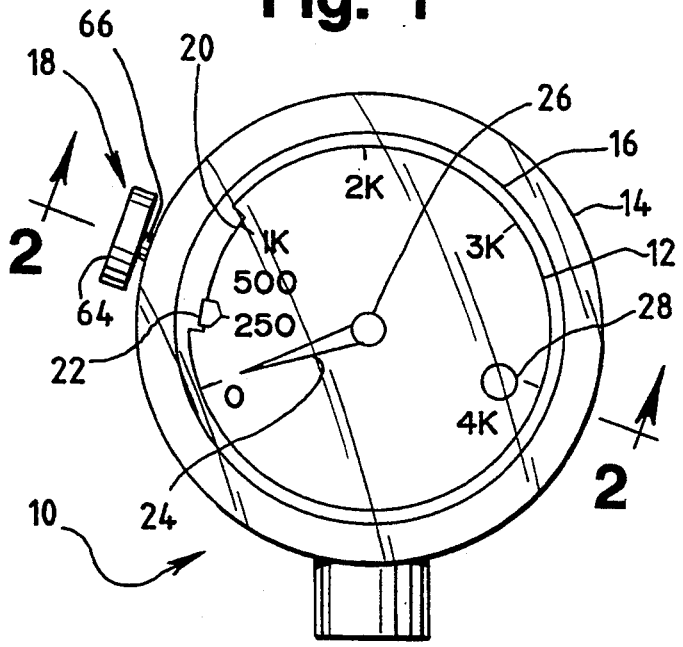
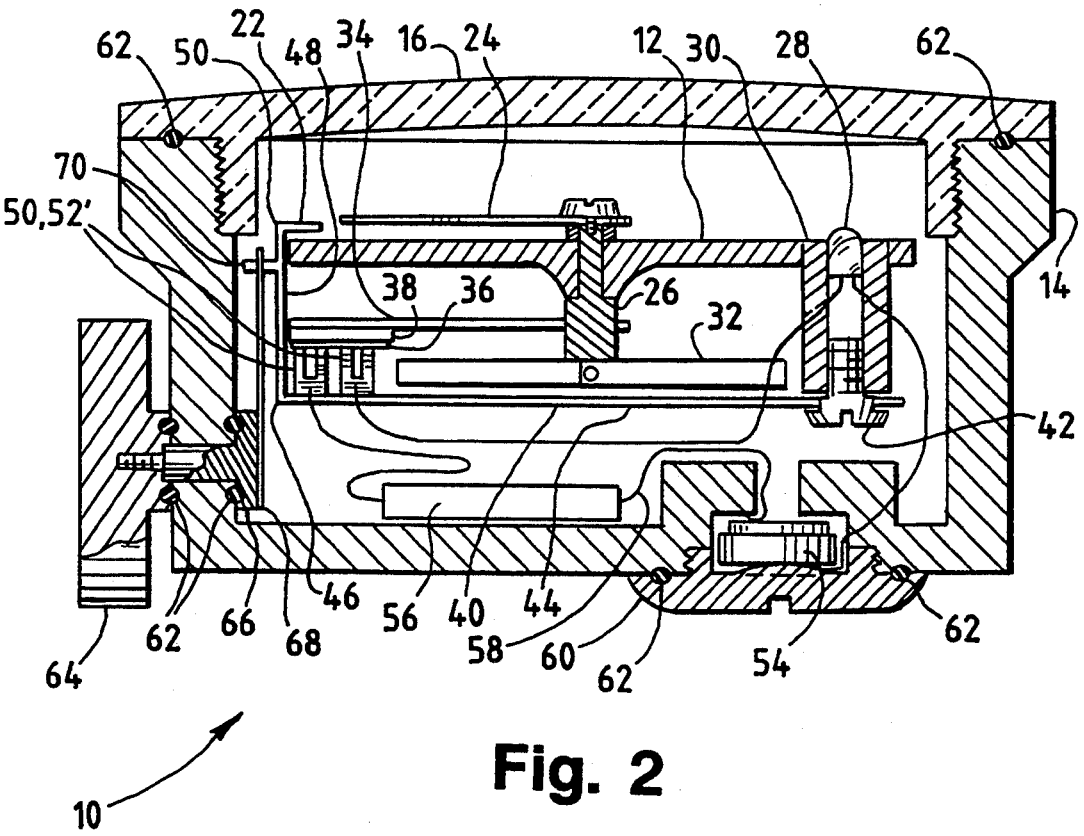
Fig. 2

AIR PRESSURE GAUGE WITH SELF CONTAINED ADJUSTABLE ALARMS

BACKGROUND

1. Field Of The Invention

This patent relates to pressure gauges, and, more particularly, to an air tank pressure gauge with audible and visual alarms for scuba divers.

2. Description Of The Related Art

Pressure gauges with alarms are known in the prior art (see, for example, U.S. Pat. No. 4,906,977). However, there remains a need for an air tank pressure gauge with audible and visual alarms for scuba divers. Such a pressure gauge should be capable of measuring pressures from at least 1000 lbs. (P.S.I.G.) down to at least 250 lbs. The gauge should be provided with both audible and visual alarms which are activated when a diver's air tank pressure reaches a preset level. The gauge should also be provided with an adjustable alarm pressure indicator such that a diver can turn off the alarms by lowering the alarm pressure and continue the dive at a shallower depth, and repeat this process until the air tank pressure reaches a minimum acceptable level.

SUMMARY OF THE INVENTION

The present invention is an air tank pressure gauge for use by scuba divers comprising a dial, an indicator lever, electrically-conductive contacts mounted on the indicator lever, and a shorting lever. The dial has a cutout portion for limiting the travel of an alarm pointer between two predetermined limits and an air tank pressure indicator needle attached to a rotatable center hub. The indicator lever is pivotally attached at one end to a shoulder screw or pivot point and has at the other end an alarm pointer. The electrically-conductive contacts are connected in series to a battery and audible and visual alarms. The shorting lever is pivotally attached at one end to the center hub and has an electrically-conductive shorting bar mounted at the end opposite the center hub. When the air tank pressure reaches a predetermined alarm level, the shorting lever aligns with the indicator lever, causing the shorting bar to contact the electrically-conductive contacts, completing an electrical circuit and thereby activating the audible and visual alarms.

It is an object of the present invention to provide an air tank pressure gauge with audible and visual alarms for use by scuba divers.

A further object is to provide an air tank pressure gauge with audible and visual alarms which can be preset prior to a dive to accommodate anticipated dive conditions.

A still further object of the present invention is to provide a pressure gauge with an adjustable alarm pressure indicator such that a diver can turn off the alarms by lowering the alarm pressure and continue the dive at a shallower depth, repeating this process until the air tank pressure reaches a minimum acceptable level.

BRIEF DESCRIPTION OF THE DRAWINGS

FIG. 1 is a front elevational view of the air tank pressure gauge of the present invention;

FIG. 2 is an enlarged cross-section view of the air tank pressure gauge of FIG. 1, taken along line 2—2;

DETAILED DESCRIPTION OF THE INVENTION

Figure 3:
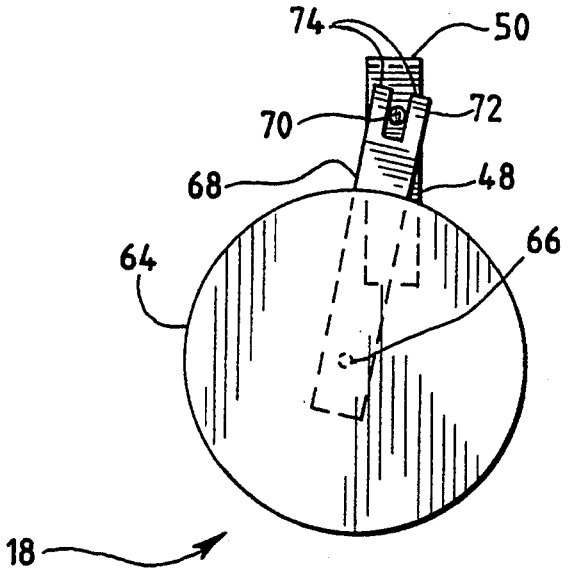
FIG. 3 is an enlarged side elevational view of the crank assembly of the air tank pressure gauge of FIG. 1.

Turning to the drawings, there is shown in FIG. 1 an air tank pressure gauge 10 according to the present invention. The pressure gauge 10 comprises a dial 12 graduated from 0 to 4,000 lbs., a watertight case 14, a dial face cover 16, and a crank assembly 18. The dial 12 has a notch or cutout 20 cut along the edge of the dial 12 which limits the travel of an alarm pointer 22, preferably between a pressure of about 250 lbs. and about 1000 lbs. An air tank pressure indicator needle 24 is attached to a rotatable center hub 26 and indicates the air tank pressure.

Preferably, the dial 12 is equipped with a light emitting diode (LED) 28 which lights up when the pressure in the air tank reaches a predetermined level. The LED 28 is held in place by an LED holder 30 which is attached to the face of the dial 12 at about the 4,000 lb. position.

As shown in FIG. 2, the center hub 26 is attached to a coiled Bourdon tube assembly 32. A shorting lever 34 is also attached to the center hub 26 between the air tank pressure indicator needle 24 and the Bourdon tube assembly 32. An electrically-conductive shorting bar 36 is mounted on the underside of the shorting lever 34 at the end opposite the center hub 26. An insulator 38 is interposed between the shorting bar 36 and the shorting lever 34.

An indicator lever 40 is pivotally attached at one end to a shoulder screw 42. The shoulder screw 42 is screwed into the base 30 of the LED holder, providing a pivot point for the indicator lever 40. The indicator lever 40 has a horizontal portion 44 which traverses the bottom of the dial 12 from the LED holder 30 to the opposite side of the dial 12, a first ninety-degree bend 46, a vertical portion 48 extending to just above the surface of the dial 12 where the indicator lever 40 terminates in a second ninety-degree bend 50 and the alarm pointer 22. The alarm pointer 22 is preferably red or another bright color, and indicates the preset air tank pressure at which the alarms will be activated.

Electrically-conductive contacts 52, 52' are mounted on the horizontal portion 44 of the indicator lever 40 near the first ninety-degree bend 46. These contacts 52, 52' are connected in series to the LED 28, a battery 54, and an audible alarm 56. One contact 52 is wired to the positive side of the LED 28. The second contact 52' is wired to the audible alarm 56. The other audible alarm wire 58 is attached to the positive end of the battery 54. The negative lead of the LED 28 is wired to the negative side of the battery 54.

Figure 4:
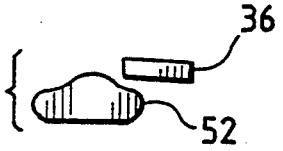
FIG. 4 is an enlarged side elevational view of the contacts and shorting bar of the air tank pressure gauge of FIG. 1.

The alarms 28, 56 are activated in the following manner. When the air tank pressure reaches the level of the preset alarm indicator pressure, the indicator lever 40 and the shorting lever 34 align. The shorting bar 36 completes the circuit across the electrically-conductive contacts 52, 52' (see FIG. 4), activating the alarms 28, 56.

The dial face cover 16 and watertight case 14 encompass the dial 12, coiled Bourdon tube assembly 32, indicator lever 40, electrically-conductive contacts 52, 52', and shorting lever 34. A battery cover 60 with a watertight seal 62 covers the battery 54. Watertight seals 62 are also located between the dial face cover 16 and watertight case 14, and between the crank assembly 18 and the watertight case 14.

The air tank pressure gauge 10 is used in the following manner. Prior to a dive, the scuba diver can set the alarm pointer 22 at a predetermined alarm setting of from about 1,000 lbs. down to about 250 lbs. As a dive progresses, the air tank pressure, indicated by the air tank pressure indicator needle 24, decreases. When the air tank pressure becomes equal to the preset indicator pressure, the audible alarm 56 will sound and the LED 28 will light, alerting the diver to the drop in air tank pressure.

At that time, the diver can turn off the alarms 28, 56 by lowering the alarm pointer 22. The diver may also wish to begin his or her ascent at this time, depending upon how much air he or she has left in the air tank.

The diver can repeat this procedure of turning off the alarms 28, 56 by lowering the alarm pointer 22 and ascending until the tank pressure reaches a minimal "safe" level of 250 lbs. Since the alarm pointer 22 cannot be set any lower than 250 lbs., the diver can only turn off the alarms 28, 56 by raising the alarm pointer 22 to a point that is higher than the air tank pressure. At this time, the diver should return to the surface because the air tank pressure is at the minimum acceptable level of 250 lbs.

The crank assembly 18 is used to change the position of the indicator lever 40 and alarm pointer 22. As best shown in FIG. 3, the crank assembly 18 comprises a knob 64, a mounting screw 66 perpendicularly mounted to the center of the knob 64, and a vertical lever 68 fixedly attached to the end of the mounting screw 66 opposite the knob 64.

The indicator lever 40 further comprises a pin 70 perpendicularly mounted on the vertical portion 48 of the indicator lever 40 and facing away from the shoulder screw 42. The pin 70 is slidably connected to the vertical lever 68. In the preferred embodiment, the vertical lever 68 has a forked end 72 with two prongs 74 and the pin 70 extends between the two prongs 74.

The position of the indicator lever 40 and the alarm pointer 22 can be changed by rotating the knob 64, which rotates the mounting screw 66, causing the vertical lever 68 to pivot about its point of attachment to the mounting screw 66. As the vertical lever 68 pivots, the indicator lever 40 pivots about the shoulder screw 42 and the alarm pointer 22 moves across the face of the dial 12. This movement is limited by the length of the cutout 20, preferably to between 250 lbs. and 1,000 lbs.

Other modifications and alternative embodiments of the invention are contemplated which do not depart from the spirit and scope of the invention as defined by the foregoing teachings and appended claims. For example, an air tank pressure gauge is contemplated having a visual alarm only, and no audible alarm.

I claim as my invention:

1. An air tank pressure gauge for use by scuba divers comprising:

a dial having a pressure indicator range from 0 lbs. to about 4,000 lbs. and marks corresponding thereto, a cutout portion for limiting the travel of an alarm pointer to between 250 lbs. and 1,000 lbs., and an air tank pressure indicator needle attached to a rotatable center hub for indicating the air tank pressure;

a light emitting diode mounted in an LED holder which is attached to the dial near the 4,000 lb. mark;

a shoulder screw screwed into the LED holder;

a coiled Bourdon tube assembly connected to the center hub;

an indicator lever pivotally attached to the shoulder screw and having a horizontal portion, a first ninety-degree bend, a vertical portion, a second ninety-degree bend, and terminating in said alarm pointer;

two electrically-conductive contacts mounted on the horizontal portion of the indicator lever near the first ninety-degree bend, said contacts connected in series to the light emitting diode, a battery, and an audible alarm;

a shorting lever pivotally attached at one end to the rotatable center hub and having an electrically-conductive shorting bar mounted at the opposite end of the lever such that when the air tank pressure reaches a predetermined level, the shorting lever aligns with the horizontal portion of the indicator lever, causing the shorting bar to contact the electrically-conductive contacts, completing an electrical circuit and thereby energizing the audible alarm and the light emitting diode.

2. The air tank pressure gauge of claim 1 in which the indicator lever further comprises a pin perpendicularly mounted to the vertical portion of the indicator lever and facing away from the shoulder screw, said pressure gauge further comprising a crank assembly for changing the position of the alarm pointer, said crank assembly having a knob, a mounting screw perpendicularly mounted to the center of the knob, and a vertical lever fixedly attached to the mounting screw at the end opposite the knob, said pin being slidably connected to the vertical lever in a manner such that the position of the alarm pointer can changed by rotating the knob.

3. The air tank pressure gauge of claim 2 further comprising a dial cover and case with watertight seals, said dial cover and case encompassing said dial, coiled Bourdon tube assembly, indicator lever, electrically-conductive contacts, and shorting lever.

4. An air tank pressure gauge comprising:

a dial having a pressure indicator range from about 0 lbs. to about 4,000 lbs. and marks corresponding thereto, a cutout portion for limiting the travel of an alarm pointer to between about 250 lbs. and about 1,000 lbs., and an air tank pressure indicator needle attached to a rotatable center hub for indicating the air tank pressure;

a coiled Bourdon tube connected to the center hub;

an indicator lever pivotally attached to a shoulder screw, said shoulder screw held in fixed relation with the dial at a position near the 4,000 lbs. mark of the dial, said indicator lever having a horizontal portion, a first ninety-degree bend, a vertical portion, a second ninety-degree bend, and terminating in said alarm pointer;

two electrically-conductive contacts mounted on the horizontal portion of the indicator lever near the first ninety-degree bend said contacts connected in series to a light emitting diode and a battery;

a shorting lever pivotally attached at one end to the center hub and having an electrically-conductive shorting bar mounted at the opposite end of the lever such that when the air tank pressure reaches a predetermined level, the shorting lever aligns with the horizontal portion of the indicator lever, causing the shorting bar to contact the electrically-conductive contacts, completing an electrical circuit and thereby energizing the light emitting diode.

* * * * *